US005483898A

United States Patent [19]

Seidl

[11] Patent Number: 5,483,898

[45] Date of Patent: Jan. 16, 1996

[54] TILTING AND SLIDING SURFACE ASSEMBLY FOR A TABLE

[75] Inventor: Lon D. Seidl, Green Bay, Wis.

[73] Assignee: Krueger International, Breen Bay, Wis.

[21] Appl. No.: 201,236

[22] Filed: Feb. 24, 1994

[51] Int. Cl.[6] ..... A47F 5/12

[52] U.S. Cl. ..... 108/3; 108/5; 248/918

[58] Field of Search ..... 108/50, 3, 1, 5, 108/143, 6; 248/918, 919, 920, 118.3, 662, 664, 676; 312/194, 322, 233.3

[56] References Cited

U.S. PATENT DOCUMENTS

| | | | |
|---|---|---|---|
| 2,773,705 | 12/1956 | Hirak | 108/5 |
| 3,848,543 | 11/1974 | Johnston . | |
| 3,866,866 | 2/1975 | Kneice | 248/918 X |
| 3,875,872 | 4/1975 | Kayner . | |
| 4,047,774 | 9/1977 | Hanning . | |
| 4,202,111 | 5/1980 | Bachley | 108/50 X |
| 4,248,161 | 2/1981 | Adair et al. . | |
| 4,305,563 | 12/1981 | Presson . | |
| 4,365,561 | 12/1982 | Tellier et al. . | |
| 4,379,429 | 4/1983 | Gubbe et al. . | |
| 4,383,486 | 5/1983 | Reineman et al. . | |
| 4,397,244 | 8/1983 | Rutsche et al. . | |
| 4,402,624 | 9/1983 | Stahl et al. . | |
| 4,421,035 | 12/1983 | Gubbe et al. . | |
| 4,428,631 | 1/1984 | Cope et al. . | |
| 4,440,096 | 4/1984 | Rice et al. . | |
| 4,469,029 | 9/1984 | Ramond . | |
| 4,515,086 | 5/1985 | Kwiecinski et al. . | |
| 4,546,708 | 10/1985 | Wilburth . | |
| 4,566,741 | 1/1986 | Eriksson et al. . | |
| 4,567,835 | 2/1986 | Reese et al. . | |
| 4,616,798 | 10/1986 | Smeenge et al. | 248/918 X |
| 4,619,427 | 10/1986 | Leymann . | |
| 4,625,657 | 12/1986 | Little et al. . | |
| 4,632,349 | 12/1986 | Anstey . | |
| 4,637,322 | 1/1987 | Hampshire et al. . | |
| 4,640,199 | 2/1987 | Zigman . | |
| 4,644,875 | 2/1987 | Watt . | |
| 4,691,888 | 9/1987 | Cotterill . | |
| 4,717,112 | 1/1988 | Pirkle . | |
| 4,725,106 | 2/1988 | Shields et al. . | |
| 4,733,618 | 3/1988 | Sarro et al. . | |
| 4,736,689 | 4/1988 | Stanko et al. | 108/5 |
| 4,776,284 | 10/1988 | McIntosh . | |
| 4,785,742 | 11/1988 | Esslinger . | |
| 4,805,538 | 2/1989 | Fisher et al. . | |
| 4,815,391 | 3/1989 | Lee . | |
| 4,843,978 | 7/1989 | Schmidt et al. . | |
| 4,844,388 | 7/1989 | Kuba et al. . | |
| 4,890,561 | 1/1990 | Hampshire et al. . | |
| 4,923,259 | 5/1990 | Bartok . | |
| 4,947,763 | 8/1990 | Piorek . | |
| 5,031,867 | 7/1991 | Cotterill . | |
| 5,036,776 | 8/1991 | Veyhl et al. . | |
| 5,037,054 | 8/1991 | McConnell . | |
| 5,037,163 | 8/1991 | Hatcher . | |

(List continued on next page.)

FOREIGN PATENT DOCUMENTS

| | | | |
|---|---|---|---|
| 580077 | 1/1994 | European Pat. Off. | 108/1 |

*Primary Examiner*—José V. Chen
*Attorney, Agent, or Firm*—Andrus, Sceales, Starke & Sawall

[57] ABSTRACT

A tilting and sliding surface for use with a table or other work surface is received within an opening or space defined by the stationary surface of the table or work surface. A combination tilting and sliding mechanism mounts the movable surface to the stationary surface. The tilting and sliding mechanism includes a fixed bracket assembly mounted to the stationary surface, and a movable bracket assembly pivotably interconnected with the fixed bracket assembly and to which the movable surface is mounted. A sliding mechanism is interposed between the movable bracket assembly and the movable surface. A tilt lock mechanism selectively clamps the movable bracket assembly to the fixed bracket assembly in a desired pivoting position according to user requirements. The sliding mechanism includes lateral guide members fitted with bearings, which are received within channel structure defined by a slide member mounted to the underside of the movable surface.

17 Claims, 2 Drawing Sheets

U.S. PATENT DOCUMENTS 5,041,770 8/1991 Seiler et al. .
5,101,736 4/1992 Bommarito et al. .
5,118,172 6/1992 Ugalde .
5,172,641 12/1992 Auer .
5,174,224 12/1992 Nagy et al. .
5,176,351 1/1993 Moore .
5,211,367 5/1993 Musculus .
5,273,250 12/1993 Pemborton et al. ..... 108/5
5,377,951 1/1995 Johnson et al. ..... 248/919 X FIG. 4
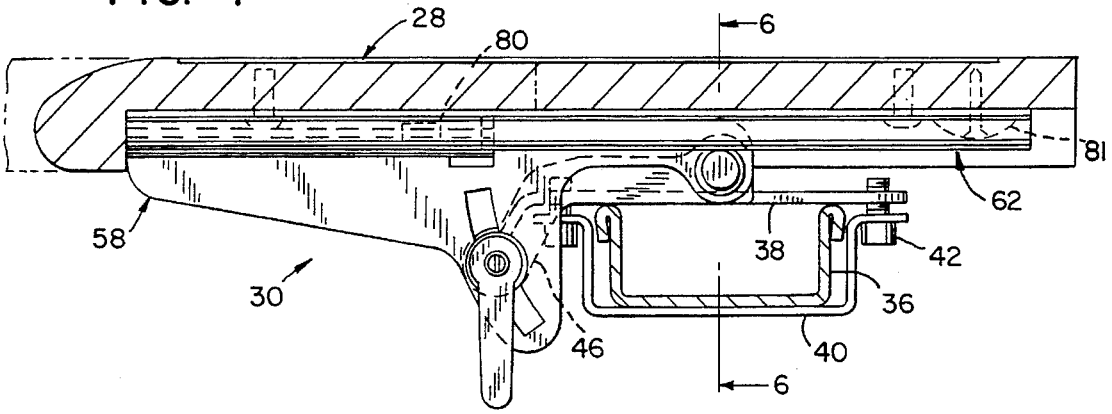
FIG. 5
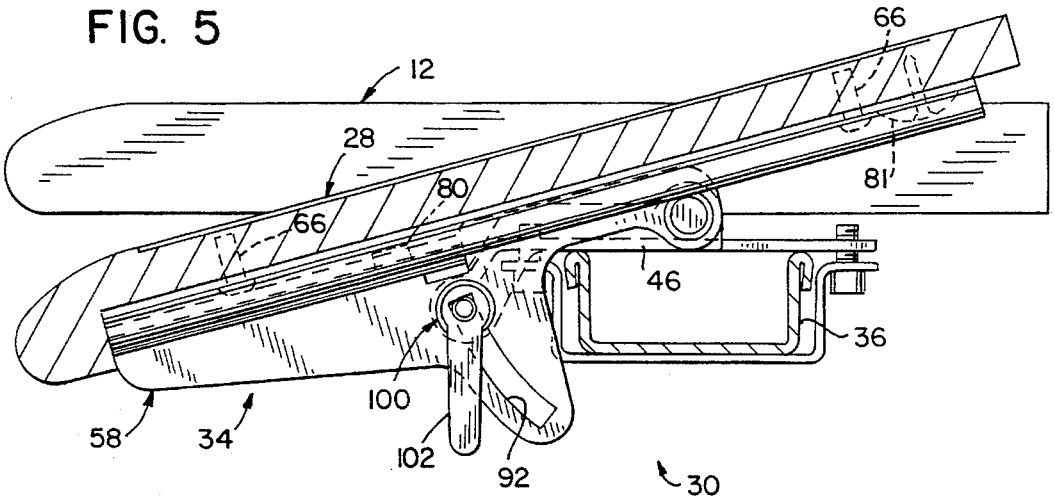
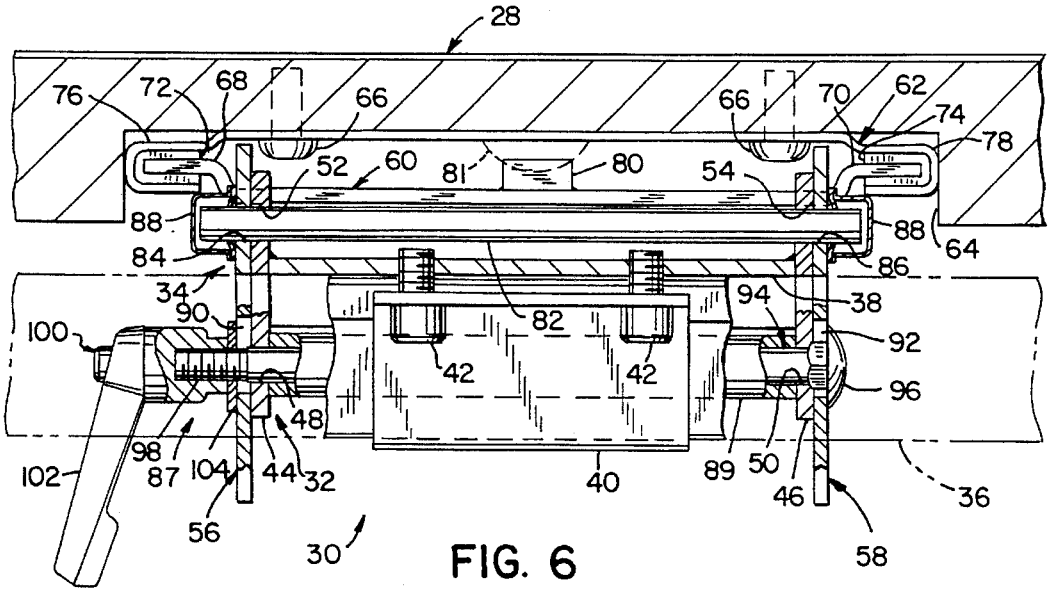
FIG. 6

TILTING AND SLIDING SURFACE ASSEMBLY FOR A TABLE

BACKGROUND AND SUMMARY OF THE INVENTION

This invention relates to a table in the nature of a worktable adapted for use with a computer or the like, and more particularly to a table including a movable surface for supporting the keyboard of a computer.

Worktables for supporting a computer are well known. Many workstations or tables for supporting a computer include a pad or surface for supporting the computer keyboard, and it is known to provide such a surface which is movable to varying positions according to individual user requirements.

It is an object of the present invention to provide a keyboard surface for use in combination with a worktable which is adapted to be received within an opening defined by the worktable, and which can be slid inwardly and outwardly relative to the table and moved to varying angular positions relative to the table. It is a further object of the invention to provide a tilting and sliding keyboard surface mechanism which is simple in its construction and operation, yet which provides highly satisfactory movement of the keyboard surface in response to user requirements. Another object of the invention is to provide a tilting and sliding mechanism for a keyboard surface which can be easily adapted for use with existing table construction.

In accordance with the invention, a movable surface assembly is adapted for use with a table which includes a pair of spaced vertically adjustable horizontal surfaces defining an opening therebetween within which the movable surface is received. The table further includes at least a pair of legs and a cross-member extending below and supporting the horizontal surfaces. The cross-member preferably extends across the opening, and is interconnected with the legs for supporting the horizontal surfaces. The invention provides a movable surface disposed within the opening, a bracket assembly engageable with the cross-member and secured to the movable surface, a manually operable pivot mechanism and a manually operable slide mechanism, both of which are interposed between the bracket assembly and the movable surface. The pivot mechanism provides movement of the movable surface about a substantially horizontal pivot axis relative to the horizontal surfaces, and the slide mechanism provides sliding inward-outward movement of the movable surface relative to the horizontal surface. The bracket assembly is defined by a first bracket stationarily mounted to the cross-member and a second bracket stationarily mounted to the movable surface. The pivot mechanism is interposed between the first and second brackets. A selectively operable tilt lock mechanism is interconnected between the first and second brackets for selectively locking the position of the second bracket relative to the first bracket to selectively lock the position of the movable surface relative to the fixed surface. The slide mechanism is in the form of a pair of laterally extending guide members secured to the second bracket. The guide members extend in an inward-outward direction parallel to the direction of movement of the movable surface. A slide member is mounted to the movable surface and defines channel structure within which the guide members are received. The guide members are defined by the ends of a plate member which is mounted to the second bracket. A bearing member is interposed between each guide member and the slide member channel structure. Each bearing member is fixedly engaged with one of the guide members, and is preferably in the form of a U-shaped member secured to each guide member. The slide member channel structure is preferably in the form of a pair of facing channels formed on a slide bracket member mounted to the underside of the movable surface, within a recess formed therein. The bearing members facilitate relative inward-outward movement between the slide and the second bracket, and thereby between the movable surface and the horizontal surfaces.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 4 is a transverse sectional view through the movable surface and a portion of the fixed surface, showing the tilting and sliding mechanism interconnecting the movable surface with the fixed surface, and in which the movable surface is in its inwardmost horizontal position;

FIG. 5 is a view similar to FIG. 4, showing the movable surface in a tilted position; and FIG. 6 is a partial sectional view taken along line 6—6 of FIG. 4.

DETAILED DESCRIPTION OF THE INVENTION

Figure 1:
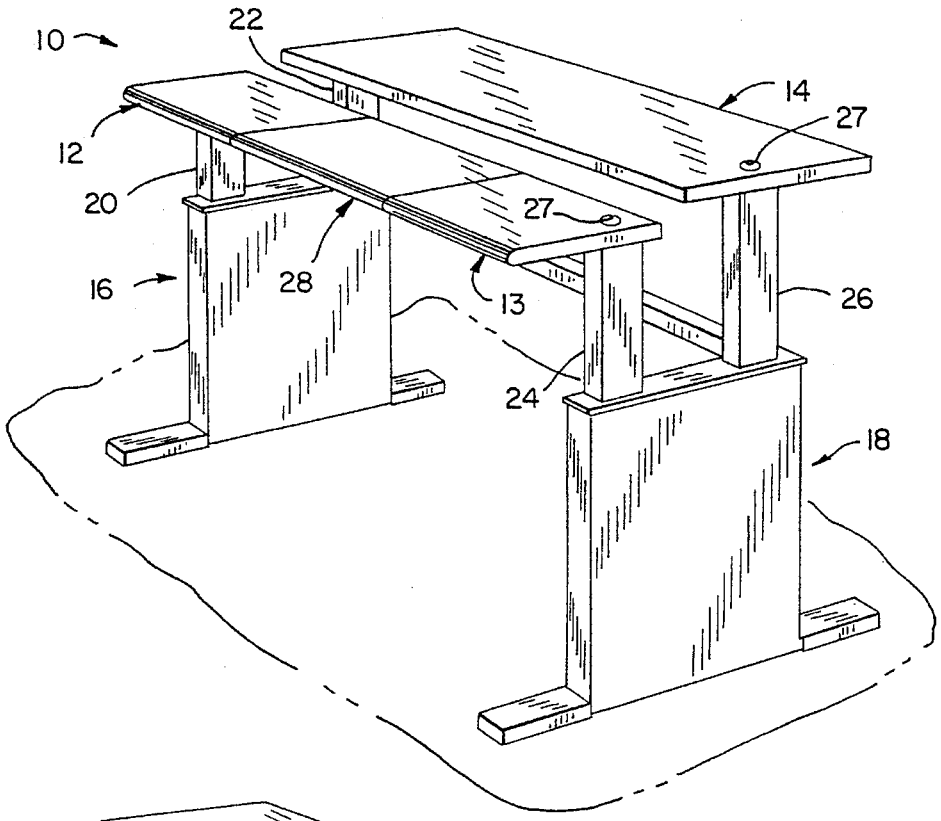
FIG. 1 is an isometric view of a table incorporating the tilting and sliding surface mechanism of the invention.

Referring to FIG. 1, a split-surface worktable 10 generally includes a pair of horizontal front surfaces 12, 13, a rear surface 14, and a pair of leg assemblies 16, 18. Leg assembly 16 includes a front leg 20 and a rear leg 22, and leg assembly 18 includes a front leg 24 and a rear leg 26. Front legs 20, 24 support front surfaces 12, 13, respectively, and rear legs 22, 26 support rear surface 14. Leg assemblies 16, 18 also include a crank-type adjustable height mechanism interconnected with each of its respective front and rear legs for providing adjustability in the elevation of front surface 12 and rear surface 14 relative to the floor. Openings 27 are formed in surfaces 13, 14, and the crank-type height adjustment mechanisms extend through opening 27.

The components and assembly described above are generally known in the art, and are commercially available from Krueger International, Inc. of Green Bay, Wis., the assignee of the present application, under its designation WorkZone and/or DataBord.

In accordance with the invention, an adjustable or movable surface 28 is interconnected with front surface 12 and is received within an opening or space 29 between front surfaces 12 and 13. Movable surface 28 is particularly well suited for supporting a computer keyboard or the like, and rear surface 14 is well suited for supporting a computer monitor.

Figure 2:
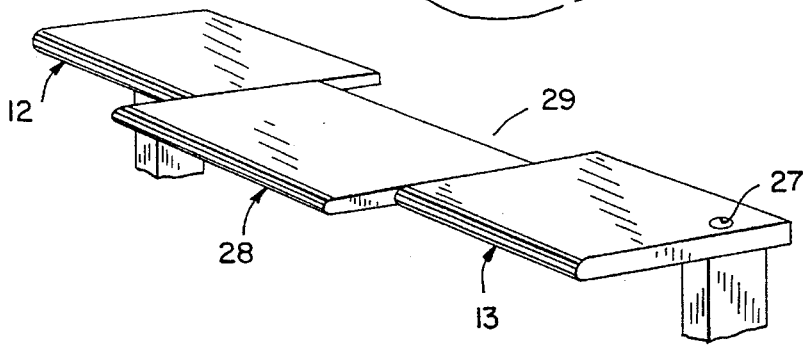
FIG. 2 is a partial isometric view of a portion of the table of FIG. 1, showing the movable surface moved outwardly relation the horizontal surfaces.
Figure 3:
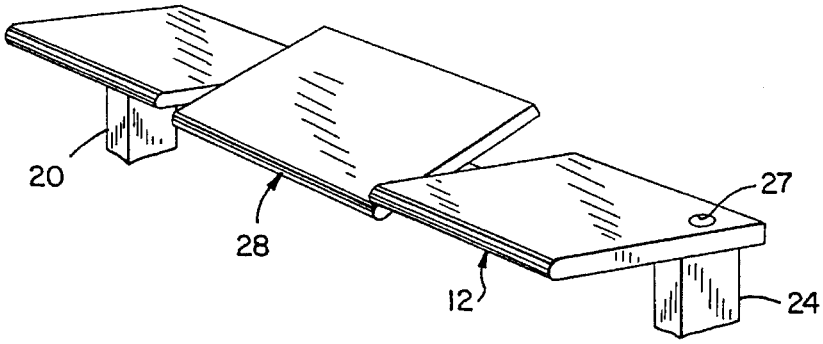
FIG. 3 is a view similar to FIG. 2, showing the movable surface in a tilted position relative to the horizontal surfaces.

Movable surface 28 is interconnected with a tilting and sliding mechanism, shown generally at 30 in FIGS. 4–6, which provides movement of movable surface 28 in an inward-outward direction and about a horizontal tilt axis. FIG. 2 illustrates movable surface 28 in its outwardmost position in which movable surface 28 is slid outwardly relative to front surfaces 12 and 13. FIG. 3 illustrates movable surface 28 tilted about a horizontal tilt axis relative to front surfaces 12 and 13. Preferably, movable surface 28 may be movable outwardly a distance of approximately 5 inches, as shown in FIG. 2, and may be tiltable approximately 15° from horizontal in either a forward tilt direction, as shown in FIG. 3, or in a rearward tilt direction.

Referring to FIGS. 4–6, tilting/sliding mechanism 30 generally includes a fixed bracket assembly 32 and a movable bracket assembly 34. Fixed bracket assembly 32 is mounted to a cross-member 36 which extends below and between horizontal surfaces 12 and 13 between legs 20, 24 through space 29 within which movable surface 28 is received. Movable bracket assembly 34 is mounted to the underside of movable surface 28.

Fixed bracket assembly 32 includes a plate 38 engageable with the top of cross-member 36, and a clam shell member 40 engageable with the bottom of cross-member 36. A series of threaded screws 42 interconnect clam shell member 40 with plate 38 for clamping fixed bracket assembly 32 to cross-member 36.

A pair of bracket arms 44, 46 are welded to the ends of plate 38. Arms 44, 46 define down turnedforward ends, and aligned forward openings 48, 50 (FIG. 6) are formed in the forward end portions of arms 44, 46, respectively. Aligned rear openings 52, 54 (FIG. 6) are formed in the rearward portion of arms 44, 46, respectively.

Movable bracket assembly 34 includes a pair of side plates 56, 58 rigidly mounted to and extending downwardly from an upper guide plate 60. A cross-member (not shown) extends between and interconnects side plate 56, 58, and guide plate 60 is fixed thereto such as by welding or the like. A slide member 62 is fixed to the underside of movable surface 28 within a recess 64 formed therein, such as by a series of screws 66.

Guide plate 60 is bent at its ends to define longitudinally extending lateral end portions 68, 70. U-shaped bearing members 72, 74 made of a thermoplastic such as nylon are fixedly engaged with guide plate end portions 68, 70, respectively. Illustratively, spaced openings (not shown) may be formed in guide plate end portions 68, 70, and bearing members 72, 74 are formed with protrusions which snap into the spaced openings in guide plate end portions 68, 70 to secure bearing members 72, 74 thereto and to prevent longitudinal movement between bearing members 72, 74 and guide plate 60.

Slide member 62 includes a pair of facing channels 76, 78 at its ends. Channels 76, 78 are shaped so as to correspond to the outer shape of bearing members 72, 74, which are received within channels 76, 78, respectively. With this construction, movable surface 28 can be moved inwardly and outwardly relative to movable bracket assembly 34 in response to exertion of a manual inward-outward force exerted by the user, with channels 76, 78 moving over bearing members 72, 74, respectively. A stop member 80 is mounted to guide plate 60, and a plate bumper 81 is screwed into the underside of movable surface 28 to prevent movable surface 28 from being drawn off of guide plate 60.

Movable bracket assembly 34 is pivotably interconnected with fixed bracket assembly 32 by means of a pivot rod 82 which extends through openings 52, 54 in fixed bracket side plates 44, 46, respectively, and through aligned openings 84, 86 formed in movable bracket side plates 56, 58, respectively. Caps 88 are engaged with the ends of pivot rod 82 to fix pivot rod 82 in position relative to fixed bracket assembly 32 and movable bracket assembly 34.

A manually operable tilt lock mechanism, shown generally at 87, is interconnected between fixed bracket arms 44, 46 and movable bracket side plates 56, 58, respectively. Tilt lock mechanism 87 includes a sleeve 88 which defines a longitudinal passage therethrough. The ends of sleeve 89 bear against the facing surfaces of fixed bracket arms 44, 46. The passage in sleeve 88 is aligned with openings 48, 50 formed in fixed bracket arms 44, 46, respectively.

Arcuate slots 90, 92 are formed in movable bracket side plates 56, 58, respectively. A locking bolt 94 extends through the passage in sleeve 89 and through openings 48, 50 in fixed bracket arms 44, 46, respectively. Bolt 94 also extends through slots 90, 92, and includes a head 96 which bears against the outer surface of movable bracket side plate 58. Bolt 94 further includes a threaded shank 98 which extends through slot 90 in side plate 56, extending outwardly therefrom. A nut member 100, which includes a handle 102, is threadedly engaged with threaded shank 98. A washer 104 is interposed between nut member 100 and movable bracket side plate 56. Bolt head 96 extends through slot 92, and engages movable bracket side plate 58 on either side of slot 92.

In operation, tilting and sliding mechanism 30 functions as follows to provide tilting and sliding movement of movable surface 28 relative to horizontal surfaces 12 and 13. To draw movable surface 28 forwardly, the user grasps the underside of surface 28 between movable bracket side plates 56, 58, where a lip is formed by recess 64. The user exerts a pull-out motion, and surface 28 is drawn outwardly by sliding movement of slide member channels 76, 78 over bearings 72, 74, respectively. To move movable surface 28 inwardly, the user exerts a push-in force on movable surface 28 and sliding movement again occurs between slide member channels 76, 78 and bearings 72, 74, respectively. If desired, a slide lock can be manually operated to selectively lock the sliding position of movable surface 28. Illustratively, such a lock could be in the form of a threaded screw fixed to either or both of guide portions 68, 70, extending downwardly therefrom through longitudinal slots formed in the lower wall of channels 76, 78. A manually operable nut is engaged with each threaded screw, and selectively bears against the lower wall of channels 76, 78 to selectively clamp channels 76, 78 to guide portions 68, 70, respectively.

To adjust the tilting position of movable surface 28, the user rotates tilt lock mechanism nut member 100 using handle 102 to release engagement between movable bracket side plates 56, 58 and fixed bracket arms 44, 46, respectively, and moves movable surface 28 to a desired tilt position by exerting an appropriate upward of downward force on the forward or rearward end of movable surface 28, as desired. When the desired position of movable surface 28 is attained, the user tightens nut member 100 using handle 102. This functions to draw bolt 94 leftwardly (FIG. 6), to clamp movable bracket side plate 58 and fixed bracket arm 46 together between bolt head 96 and sleeve 89, and to clamp movable bracket side plate 56 and fixed bracket arm 44 together between washer 104 and sleeve 89. This frictional clamping of movable bracket assembly 34 to fixed bracket assembly 32 selectively maintains movable surface 28 in its desired tilting position.

As can be appreciated, the sliding movement of movable surface 28 is independent of the tilting of movable surface 28. That is, surface 28 can be slid inwardly and outwardly at any tilting position, and conversely the tilting position of movable surface 28 can be changed at any inward/outward position of surface 28.

In addition, tilting/sliding mechanism 30 and movable surface 28 can easily be retrofit onto an existing split-surface worktable by replacing an existing horizontal front surface with lateral horizontal surfaces 12 and 13 with space 29 therebetween, clamping tilting/sliding mechanism 30 to cross-member 40 using plate 38 and clam shell member 40, and then mounting movable surface 28 to slide member 62 using screws 66.

Various alternatives and embodiments are contemplated as being within the scope of the following claims particularly pointing out and distinctly claiming the subject matter regarded as the invention.

I claim:

1. A table comprising:

a first surface having a space therein;

table legs;

a cross-member extending below the first surface; a movable surface;

a bracket assembly engageable with the cross-member and secured to the movable surface;

a manually operable pivot mechanism interposed between the bracket assembly and the movable surface for selectively providing pivoting movement of the movable surface about a substantially horizontal pivot axis relative to the first surface; and a manually operable slide mechanism interposed between the bracket assembly and the movable surface for selectively providing sliding inward-outward movement of the movable surface relative to the first surface;

wherein the movable surface is coplanar with the first surface when the movable surface is within the space in the first surface and the movable surface is in one of various positions.

2. The table of claim 1, wherein the bracket assembly includes a first bracket stationarily mounted to the cross-member and a second bracket fixed to the movable surface, wherein the pivot mechanism is interposed between the first and second brackets.

3. The table of claim 2, wherein the pivot mechanism comprises a pivot rod pivotably interconnecting the first and second brackets.

4. The table of claim 3, further comprising a manually operable locking mechanism interconnected between the first and second brackets for selectively fixing the pivoting position of the second bracket relative to the first bracket, and thereby fixing the pivoting position of the movable surface relative to the first surface.

5. The table of claim 4, wherein the locking mechanism comprises a sleeve having ends bearing against one of the brackets, a threaded member extending through the sleeve and having a head bearing against the other of the brackets and a threaded end extending outwardly of the other of the brackets, and a manually operable locking nut including a handle threadedly engageable with the threaded end.

6. The table of claim 2, wherein the slide mechanism comprises a guide member mounted to the second bracket and a slide member mounted to the movable surface and slidingly engageable with the guide member.

7. The table of claim 6, wherein the guide member comprises a plate-like member defining a pair of laterally spaced ends extending in an inward-outward direction, and wherein the slide member is slidingly engaged with the guide member ends.

8. The table of claim 7, further comprising a bearing member interposed between the slide member and each guide member end.

9. The table of claim 8, wherein the bearing member comprises a thermoplastic U-shaped member stationarily mounted to each guide member end, and wherein the slide member defines a pair of facing channel end portions engageable with the U-shaped thermoplastic bearing members.

10. The table of claim 2, wherein the first surface defines a space within which the movable surface is received, and wherein the cross-member extends through the space.

11. The table of claim 10, wherein the first bracket is stationarily mounted to the cross-member by means of a plate member engageable with the upper surface of the cross-member and a clam shell member engageable with the underside of the cross-member and secured to the plate member.

12. In a table including a first surface and defining a space within which a movable surface is received, a tilting and sliding mechanism for mounting the movable surface to the first surface, comprising:

a first bracket assembly stationarily mounted relative to the first surface;

a second bracket assembly mounted to the movable surface and pivotably interconnected with the first bracket assembly;

a selectively operable tilt lock interconnected between the first and second bracket assemblies for selectively locking the second bracket assembly to the first bracket assembly for selectively locking the position of the movable surface relative to the first surface; and a slide mechanism interposed between the movable surface and the second bracket assembly for providing sliding inward-outward movement of the movable surface relative to the first surface, comprising a pair of laterally extending guide members secured to the second bracket assembly and longitudinally extending in a direction parallel to the direction of movement of the movable surface; a slide member mounted to the movable surface and defining channel structure within which the guide members are received; and a bearing member interposed between each guide member and the slide member channel structure;

wherein the movable surface is coplanar with the first surface when the movable surface is within the space in the first surface and the movable surface is in one of various positions.

13. The mechanism of claim 12, wherein each bearing member is fixedly engaged with one of the guide members and is received within the channel structure defined by the slide member.

14. The mechanism of claim 13, wherein each bearing member comprises a U-shaped member secured to one of the guide members.

15. The mechanism of claim 12, wherein the slide member channel structure comprises a pair of facing channels formed on a slide bracket member mounted to the underside of the movable surface.

16. The mechanism of claim 15, wherein the slide bracket member is mounted to the movable surface in a recess formed in the underside of the movable surface.

17. The mechanism of claim 12, wherein the first bracket assembly is mounted to a cross-member extending below the first surface of the table below the opening within which the movable surface is received.

* * * * *